US011021303B2

(12) United States Patent
Ramsey et al.

(10) Patent No.: US 11,021,303 B2
(45) Date of Patent: Jun. 1, 2021

(54) CONTAINER CLOSURE WITH RIBS FORMED IN SEALING COMPOUND

(71) Applicant: CROWN PACKAGING TECHNOLOGY, INC., Alsip, IL (US)

(72) Inventors: Christopher Paul Ramsey, Oxfordshire (GB); Philip Norman Horton, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 16/318,228

(22) PCT Filed: Jun. 1, 2017

(86) PCT No.: PCT/GB2017/051576
§ 371 (c)(1),
(2) Date: Jan. 16, 2019

(87) PCT Pub. No.: WO2018/020206
PCT Pub. Date: Feb. 1, 2018

(65) Prior Publication Data

US 2019/0161248 A1 May 30, 2019

(30) Foreign Application Priority Data

Jul. 25, 2016 (GB) ..... 1612852

(51) Int. Cl.

| | |
|---|---|
| ***B65D 41/17*** | (2006.01) |
| ***B65D 41/04*** | (2006.01) |
| ***B65D 51/16*** | (2006.01) |
| ***B65D 53/02*** | (2006.01) |
| ***B65D 1/02*** | (2006.01) |

(52) U.S. Cl.
CPC ..... *B65D 41/17* (2013.01); *B65D 1/0253* (2013.01); *B65D 41/0457* (2013.01); *B65D 51/1688* (2013.01); *B65D 53/02* (2013.01)

(58) Field of Classification Search
CPC ..... B65D 41/17; B65D 1/0253; B65D 53/02; B65D 51/1688; B65D 41/0457; B65D 43/02; B65D 2543/00546; B65D 1/10
See application file for complete search history.

(56) References Cited

U.S. PATENT DOCUMENTS

| | | | | |
|---|---|---|---|---|
| 3,270,904 A | | 9/1966 | Foster et al. | |
| 3,371,813 A | | 3/1968 | Owen et al. | |
| 3,520,436 A | * | 7/1970 | Vercillo | B65D 41/0457 215/348 |

(Continued)

FOREIGN PATENT DOCUMENTS

| | | |
|---|---|---|
| CN | 104271455 A | 1/2015 |
| CN | 108602592 A | 9/2018 |

(Continued)

*Primary Examiner* — James N Smalley
(74) *Attorney, Agent, or Firm* — BakerHostetler

(57) ABSTRACT

A closure for a container. The closure comprises an end panel, a sidewall depending from the end panel and having an inwardly directed curl, and a sealing compound extending down the inner surface of the sidewall. A plurality of ribs are formed in the sealing compound, spaced apart around the circumference of the sidewall, each rib extending down the sidewall and projecting radially inwardly.

16 Claims, 8 Drawing Sheets

(56) References Cited

U.S. PATENT DOCUMENTS

| | | | | | |
|---|---|---|---|---|---|
| 4,000,825 | A * | 1/1977 | Westfall | B65D | 41/0457 215/318 |
| 4,552,279 | A | 11/1985 | Mueller et al. | | |
| 4,709,825 | A | 12/1987 | Mumford | | |
| 6,786,348 | B2 * | 9/2004 | Martin | B65D | 41/0457 215/318 |
| 2002/0175138 | A1 | 11/2002 | Martin et al. | | |
| 2015/0108132 | A1 | 4/2015 | McGirr | | |

FOREIGN PATENT DOCUMENTS

| | | | |
|---|---|---|---|
| DE | 4332544 | A1 | 3/1995 |
| EP | 2662296 | A1 | 11/2013 |
| GB | 2126567 | | 3/1984 |
| WO | WO 02/094670 | A1 | 11/2002 |
| WO | WO 2013/167483 | A1 | 11/2013 |
| WO | 2014184131 | A2 | 11/2014 |
| WO | 2017145083 | A1 | 8/2017 |

* cited by examiner

Conventional PT jar finish
Overall height 7.4 mm
Height of top seal region 2.0 mm
Height under thread 1.7 mm Jar finish for internally curled closure
Overall height 5.6 mm
Height of top seal region 1.0 mm
Height under thread 1.0 mm

CONTAINER CLOSURE WITH RIBS FORMED IN SEALING COMPOUND

CROSS-REFERENCE TO RELATED APPLICATIONS

This application is the National Stage of International Application No. PCT/GB2017/051576 filed Jun. 1, 2017, which claims the benefit of GB application number 1612852.2, filed Jul. 25, 2016, the disclosures of which are incorporated herein by reference in their entirety.

TECHNICAL FIELD

The invention relates to closures for use with container bodies including, but not limited to, glass container bodies. More particularly, though not necessarily, the invention relates to such closures that are configured to be re-closeable over the container bodies.

BACKGROUND

Containers are well known in which a metal, releasable closure is provided on an underside with a layer of sealing compound such as plastisol. A typical example of such a container is the commonplace "jam jar" in which the closure is applied to a glass container body. Traditionally, the closure is screw fitted onto the container body such that the upper surface of the neck of the container seals against the layer of sealing compound. The screw thread is formed by a moulded thread formed around the neck of the container body and a thread or lugs formed around the sidewall of the closure. Filling speeds for such containers are generally up to about 500 containers per minute, with the speed being limited by the need for relative rotation of the closure and the container body during closure.

Because of the time taken to fit a screw closure during production, a modified arrangement has been developed in which a closure is formed without a thread or lugs, but rather with sealing compound applied evenly around the lower periphery of the end panel and down the inside of the closure sidewall or skirt. This kind of closure may be push fitted onto a screw threaded container following filling. As a result of steam injected into the headspace of the container following filling, the sealing compound softens and the screw threads of the container dig into the sealing compound. When the compound has cooled, the result is at least a partial thread within the sealing compound such that, when the container comes to be opened, relative rotation of the closure and container body will break the seal and allow the closure to be removed. Filling speeds for such containers may be up to about 1,000 containers per minute.

This arrangement is useful for certain food products where a partial vacuum is maintained in the container after filling and closure. During the filling process, steam is injected into the open container in the head space above the hot food product which has been poured into the container. The closure is then pressed down onto the container and, as the steam condenses, a partial vacuum is formed in the container above the head space which acts to hold the closure firmly in place on the container body. In the fully cooled and filled container, the typical vacuum in the container is about −0.3 bar. This partial vacuum must be vented to allow the closure to be removed otherwise the combined resistance of the vacuum and the friction due to the thread may be difficult or even impossible to overcome.

In another known container, a glass container body in the form of a glass tumbler is formed with an annular bead around its upper end. The tumbler body is moulded and then treated in order to melt its upper end edge to form the bead which is smooth for drinking. A flexible aluminium closure is snapped over the bead and forms a seal with the body by virtue of a partial vacuum formed in the container during processing. The seal is broken by prying off the closure. A steel closure cannot be used in this arrangement since steel is not sufficiently flexible for use in a pry-off closure.

WO2013167483 describes a container comprising a releasable and resealable metal closure for a glass jar. The closure is threadless and is retained on the jar only by means of a partial vacuum formed in the container body during processing. An annular sealing surface of the container body is provided with a protrusion or recess which produces a complimentary feature in the sealing compound during and following attachment of the closure. When the closure is twisted to open, these features separate creating a venting path via which air can flow into the container, thereby allowing the lid to be lifted off the container body.

SUMMARY

According to a first aspect of the present invention there is provided a closure for a container. The closure comprises an end panel, a sidewall depending from the end panel and having an inwardly directed curl and a smooth outwardly facing surface, and a sealing compound extending down the inner surface of the sidewall. A plurality of ribs are formed in the sealing compound, spaced apart around the circumference of the sidewall, each rib extending down the sidewall and projecting radially inwardly. The sealing compound may additionally extend around an inner periphery of the end panel.

Embodiments of the invention may provide for a rimless closure which is re-closeable over a container and which has a reduced depth, allowing lightweighting, whilst at the same time reducing the volume of sealing compound required to form the closure.

Each rib may extend down the sidewall substantially from the junction with the end panel to the curl. The ratio of the radial thickness of each rib to the radial thickness of the layer of sealing compound between the ribs may be at least 2:1, preferably at least 4:1, and more preferably at least 8:1. The ribs may have a radial thickness of approximately 1.7 at least 1.5 mm and the layer of sealing compound between the ribs may have a radial thickness of approximately 0.2 less than 0.4 mm.

The end panel and the depending sidewall may be of metal, preferably steel.

The total number of ribs may be between three and thirty six, more preferably between four and sixteen.

The maximum external diameter of the closure may be in the range 52 to 57 and the closure may have a depth of less than 10 mm, preferably approximately 6 mm.

The sealing compound may be PVC plastisol or moulded TPE.

The innermost surface of each rib may be angled relative to the axis of the container, along the length of the rib, for example by approximately 5 degrees.

According to a second aspect of the present invention there is provided a container comprising a closure according to the above first aspect of the present invention, and a container body. The inner diameter of the closure defined by the curl may be greater than the outer diameter of a neck of the container such that there is substantially no contact, either during or after closing, between the closure and the container other than via the sealing compound.

The container body may be of glass and may comprise a neck with an annular sealing surface surrounding an opening and adapted to seal against the sealing compound over an annular sealing interface in the closed position of the closure on the container body due to a partial vacuum formed in the container during processing. The annular sealing surface or other part of the neck is provided with one or more irregularities around or in which the sealing compound sets, whereby relative rotation of the closure and container body from the closed position creates a venting path from the interior of the container body to the exterior so that the seal is broken and the closure is released The or each irregularity may be a pip of substantially circular cross-section or a radially extending rib.

A neck of the container body may define, in the region that makes contact with said ribs, one or more features having a circumferential extent and being inclined across that extent, wherein said ribs set around the features such that rotation of the closure relative to the container causes the lid to rise up along the features. The one or more features may comprise a thread or threads or angled nibs.

DETAILED DESCRIPTION

Figure 1:
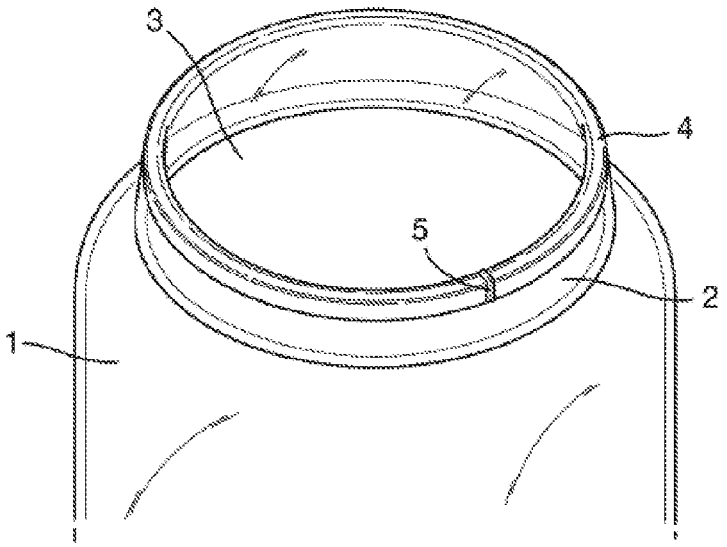
FIG. 1 is an isometric view of the top portion of a first container body known in the prior art.
Figure 2:
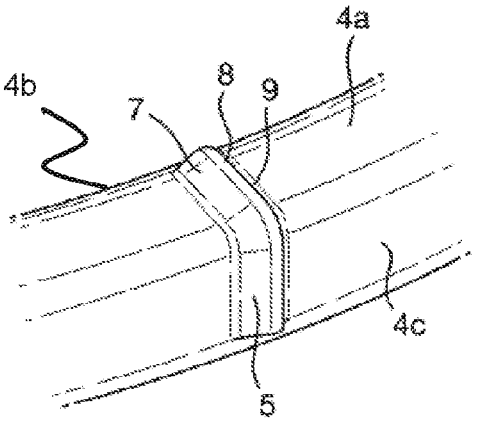
FIG. 2 is an enlarged view of part of the neck of the body of FIG. 2.
Figure 3:
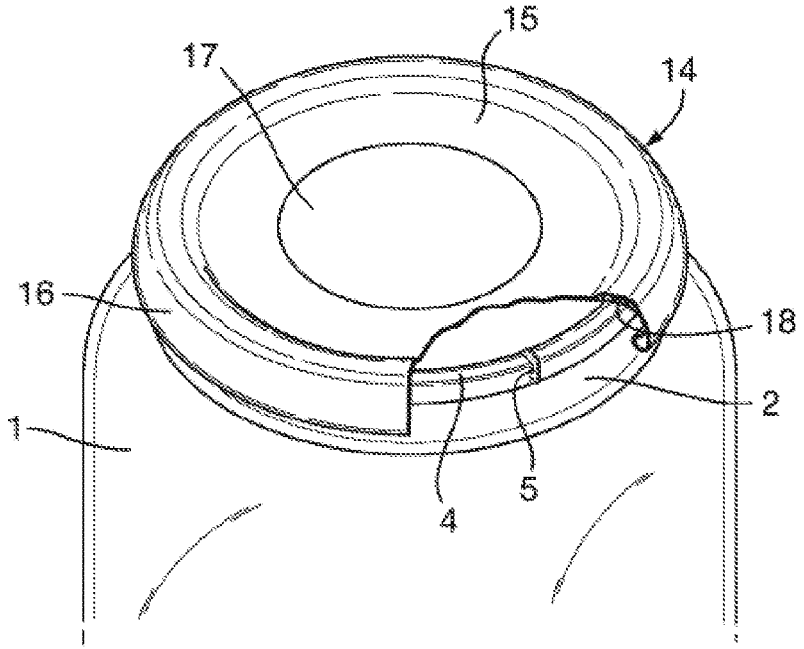
FIG. 3 is an isometric view, partially cut away, of the top portion of the container body of FIG. 1 provided with a closure.
Figure 4:
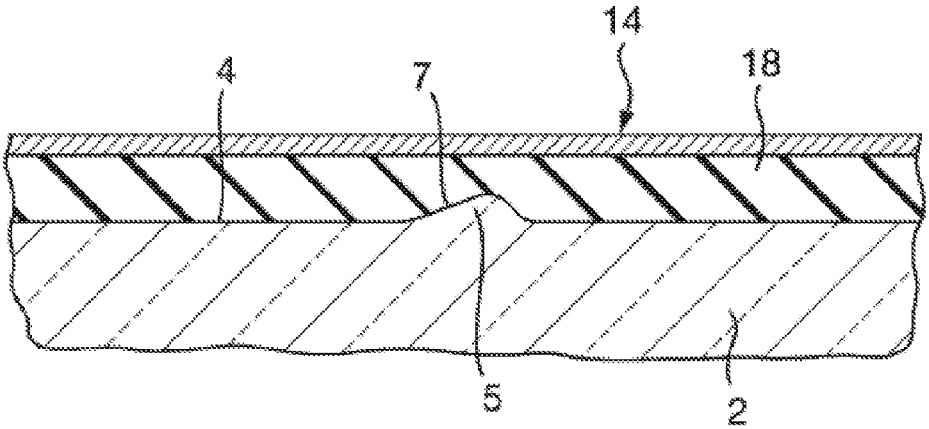
FIG. 4 is a circumferential sectional view through part of the container and closure of FIG. 3 in the closed portion.
Figure 5:
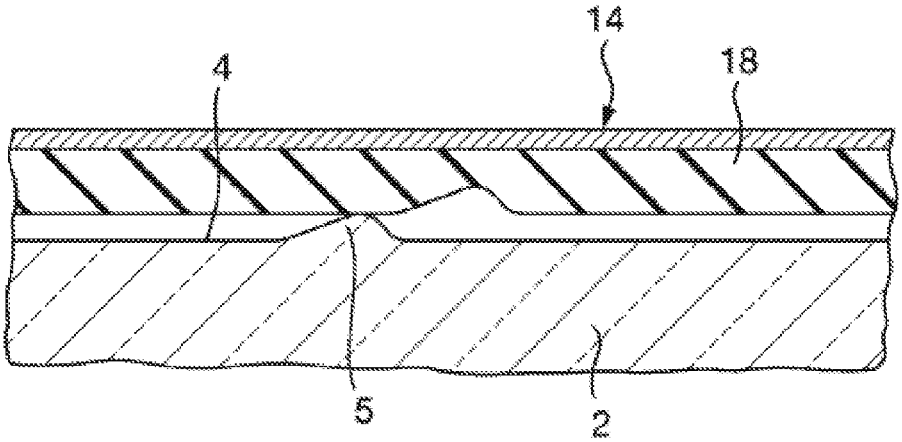
FIG. 5 is a circumferential sectional view through part of the container and closure of FIG. 3 after relative rotation.

As discussed briefly above, WO2013167483 describes a releasable and resealable metal closure for a glass jar. This known container is illustrated in FIGS. 1 to 5 and comprises a glass container body 1 having a neck 2 defining a circular opening 3 surrounded by an upper rim. The upper rim provides an annular sealing surface 4 which is provided primarily by the generally flat top edge face 4*a* of the neck and also by the upper parts of the inner and outer surfaces 4*b*, 4*c* of the neck. A venting feature comprising a localised discontinuity in the surface 4 is provided by a small protrusion 5 which extends generally radially across the surface 4 so as to extend downwardly beyond the reach of the annular layer of sealing compound when a closure is fitted as best seen in FIG. 2 so that it extends continuously from the interior of the container body to the exterior of the container body. The protrusion has a curved circumferential profile generally comprising an upslope 7, a curved top and a downslope. The upslope 7 is inclined to the surface 4 at an angle θ which is less than 30°. The angle θ is on the trailing edge so that a jar can be opened by rotating the closure conventionally anti-clockwise.

In one embodiment the container neck has an external diameter of about 51 mm and the protrusion has a circumferential length of about 1.0 mm and a height of about 0.2 mm. All the radiuses on the protrusion are about 0.2 mm. This is so that the features can press into the soft sealing compound to create a continuous sealing surface during capping. Such a container body may be moulded from glass.

The known closure is of metal and comprises an end wall 15 and a depending skirt 16. The end wall has a central pop-up panel known as a "vacuum button" 17 which is normally held in a concave shape by the partial vacuum in the closed container. The button pops-up to a convex shape to give a warning that the vacuum has been vented and thus the seal has been broken. An annular layer 18 of sealing compound is formed on the inside of the closure end wall adjacent the skirt 16. This layer of compound seals against the annular sealing surface 4 of the container neck over an annular sealing interface in the closed position of the closure 14 on the body 1. The sealing compound is PVC plastisol and is applied to the closure (in the inverted position) through a nozzle and allowed to settle under gravity to form a generally even annular layer. It is cured before the filling process but will be softened during the filling and capping process by steam in the head space above the food product; this allows the sealing compound to flow around or into the venting feature 5, 10 and set around the annular sealing surface 4. This is best illustrated in the cross-sectional view of FIG. 4.

During capping, the sealing compound is typically heated and applied with an axial load so that it deforms to the jar profile to create a gas tight seal. The jar may then be processed by pasteurization or sterilization to provide extended shelf life of the product. During capping, processing or subsequent storage and distribution, the compound typically takes a permanent set so that the profile when opened is different to the original uncapped profile.

When the closure 14 is rotated relative to the container body (it will be natural for the closure to be rotated anti-clockwise since consumers are accustomed to opening containers in this way), venting of the vacuum in the container takes place. Venting takes place because there is now a path created between the compound and container as the sealing surfaces separate. After venting and further rotation the closure moves away from the container as illustrated in the cross-sectional view of FIG. 5.

WO2013167483 also describes an alternative embodiment in which the discontinuity is provided by a shallow recess or groove having a continuously curved surface. The recess again extends radially across the sealing surface and partially down the inner and outer surfaces of the neck so that it extends continuously from the interior of the container body to the exterior of the container body.

According to the embodiments of WO2013167483, the closure is primarily retained on the container body by means of the vacuum seal, although it does describe the optional provision of lobes at the bottom of the closure skirt (formed in the metal) which provide a loose snap-over fit with the bead surrounding the opening of the body. This feature assists with re-fitting of the closure after opening. This possibility to re-close the container body is desirable in order to provide a "dust cover", i.e. to prevent ingress of contaminants and other particles into the container body following first opening. The container body might be re-closed, for example, when placing a previously opened container into the fridge for use later in the day. Often, a complete reseal is not required, as this might encourage long term storage of a product that rapidly decays, e.g. baby food. Retention features provided to allow for re-closure may also be helpful to improve abuse strength of the container during manufacture. After capping during production it takes some time for the vacuum to fully form in the headspace; the product needs to be fully cooled before a full vacuum is created. During this time retention features can help to overcome shocks in the handling of the containers.

Figure 6A:
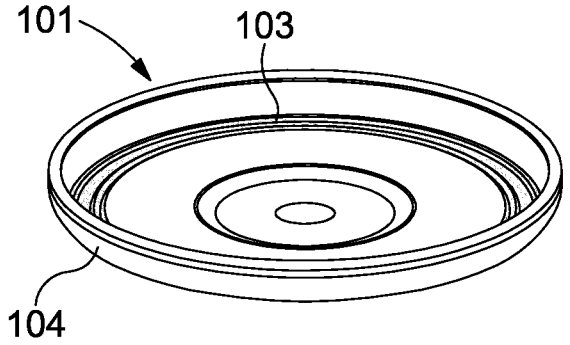
FIG. 6 illustrates a closure and a container, the closure having an inward curl with a degree of elasticity to allow for re-closure.
Figure 6B:
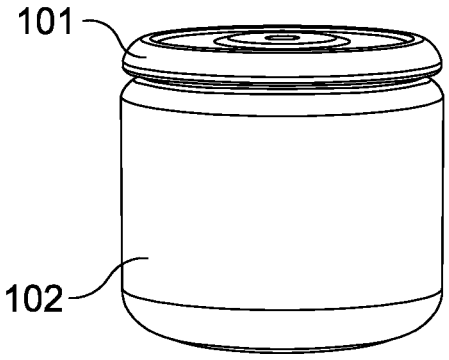
Figure 6C:
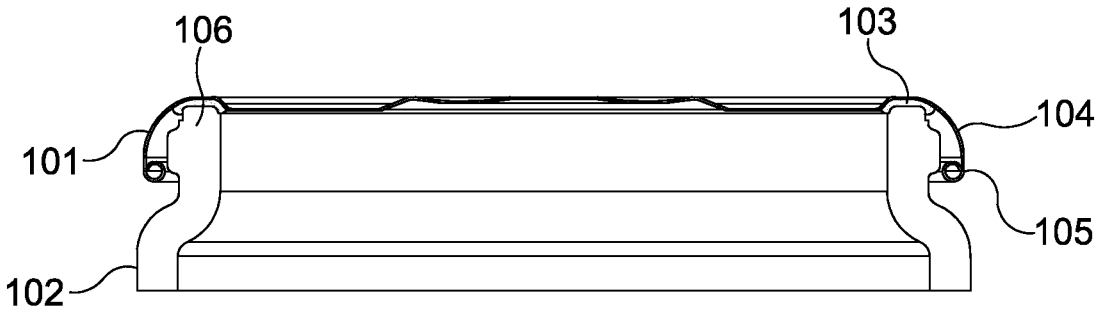

As an alternative to the use of lobes formed at the bottom of the closure skirt (WO2013167483), the approach illustrated in FIG. 6 can be considered. These Figures illustrate the container closure 101 and the container body or jar 102. The underside of the metal closure 101 is provided with an annular layer of sealing compound 103. The Figures do not show the discontinuity present on the rim of the closure but this is assumed to be present (either as a single discontinuity, as illustrated in FIGS. 1 to 5, or a plurality of circumferentially spaced discontinuities). The skirt 104 has a rounded profile, with the bottom of the skirt being curled inwardly to form a lower curl 105. The curl provides for a very small degree of elasticity, allowing the closure to be press-fitted over the rim 106 formed around the closure opening. Upon rotation of the closure, the closure is raised as a result of the discontinuity, causing the curl to rise above the rim and allowing the container to vent.

The solution of FIG. 6 has the disadvantage that the actual degree of elasticity of the closure is very limited—a band of metal does not allow for expansion and the expansion provided for by the curl is small. It relies therefore on a very small tolerance in the diameter of the rim around the container opening; if the rim diameter is too small the closure fit will be too loose, and if the rim diameter is too large the closure will not fit at all. However, in the case of glass jars, this diameter is difficult to control as the mould wears quickly so tools only last a few days. As the parts wear they grow larger and are ground to maintain the perimeter length thus becoming oval. Tolerance on the glass finish is typically only specified at plus or minus 0.4 mm for the diameter. Whilst the tolerance on the metal closure can be very accurate as the component is die curled, it is the relatively open tolerance on the glass container that is the limiting factor. It is therefore difficult or even impossible to achieve a straightforward metal to glass push fit as the interference when at maximum glass tolerance makes the closure impossible to remove. Even if this problem could be overcome, the solution adds to the torque required to open the container. Opening torques with conventional compound materials are currently at the limit of acceptability.

A primary objective when designing metal closures is to reduce the amount of metal in the closures, a process known as "lightweighting". One way to achieve this is to reduce the length of the sidewall or skirt of the closure. In the case where compound is provided between the closure sidewall and the container neck, the closure may be provided with an outwardly directed curl in order to minimize the gap and thereby reduce the amount of compound used. However, when the length of the sidewall is reduced to achieve lightweighting, e.g. from 10 mm to 6 mm, it has been found that the outwardly directed curl interferes with the user's grip on the closure, making opening difficult. The curl is therefore preferably directed inwardly, but this then causes a return to the problem of a relatively large gap between neck and closure and the requirement to increase the size of the lining compound features/geometry.

Figure 7A:
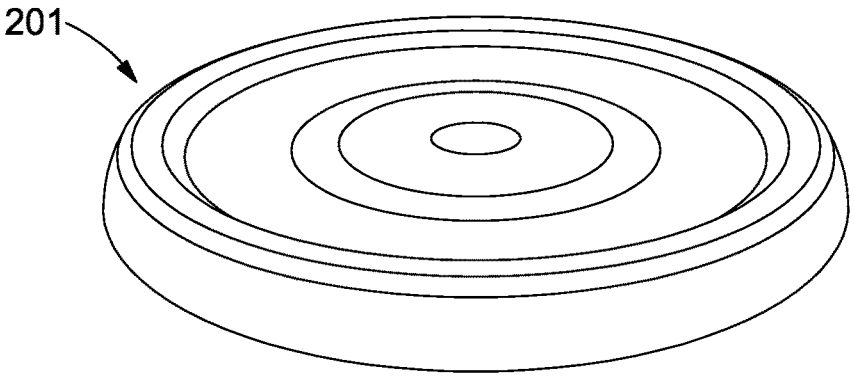
FIG. 7 illustrates a closure having a sealing compound provided on an inner surface thereof, a plurality of ribs being formed in the sealing compound.
Figure 7B:
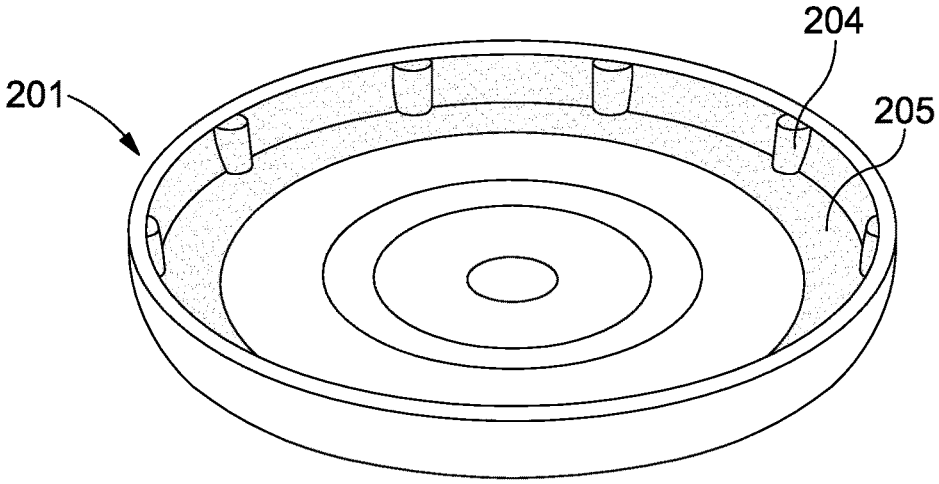
Figure 7C:
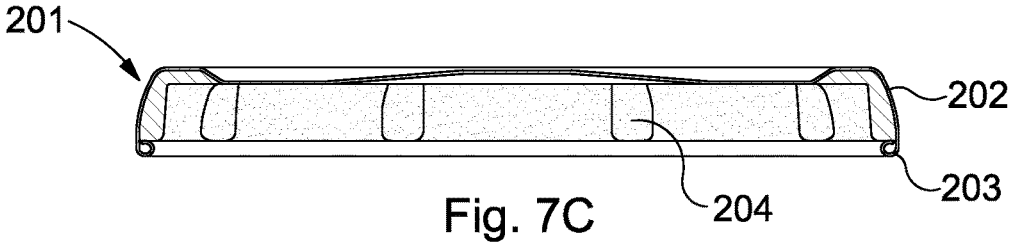
Figure 7D:
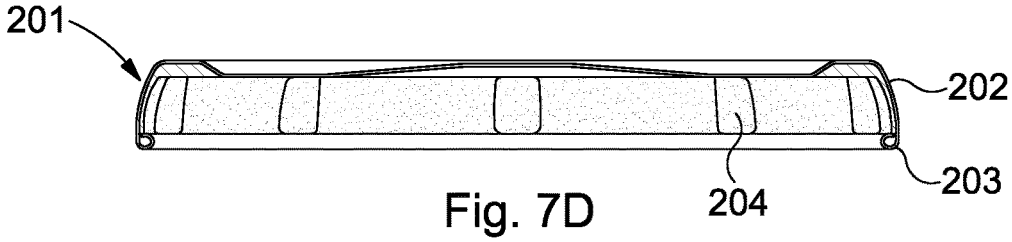
Figure 8A:
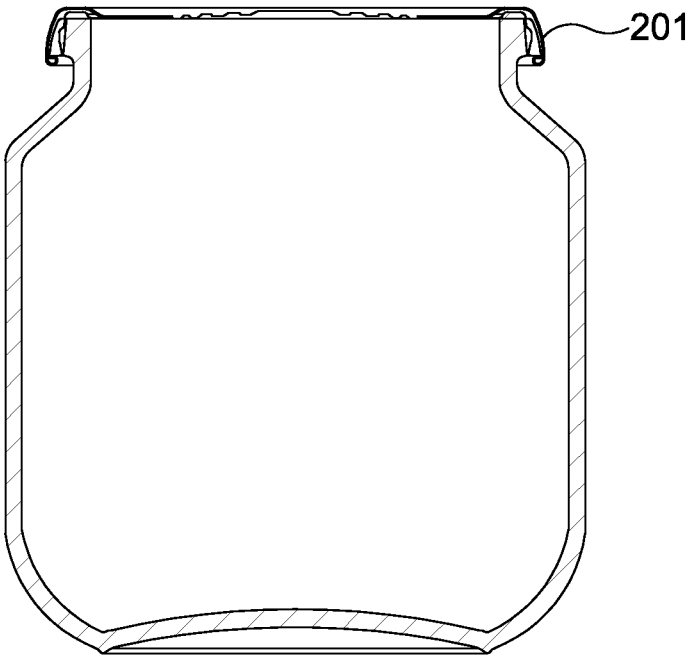
FIG. 8 shows in cross-section the closure of FIG. 7 fitted over a container.
Figure 8B:
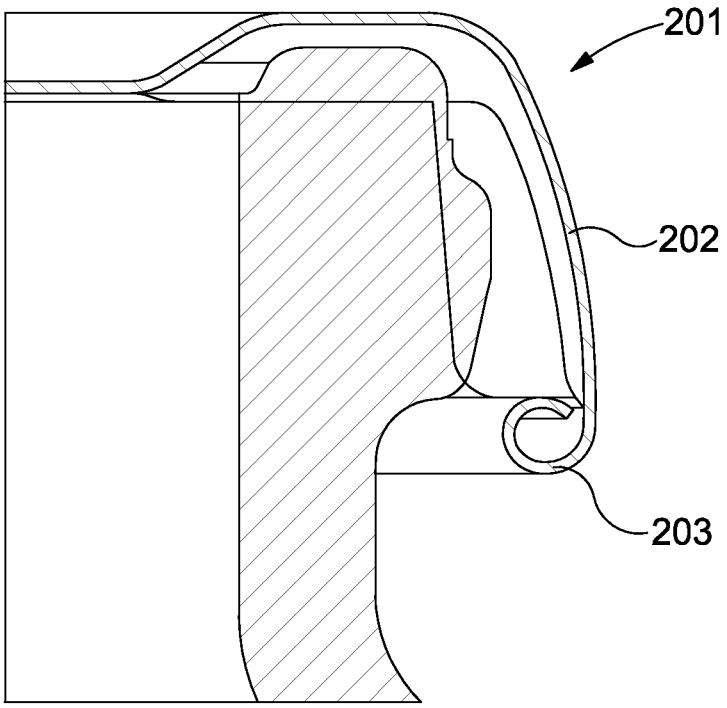

FIG. 7 illustrates an alternative closure 201 that overcomes some of the problems discussed above. FIG. 8A illustrates the closure attached to a container, with FIG. 8B showing a detail of the closure skirt and container neck. It is assumed that the rim of the container is provided with one or more discontinuities, as described above with respect to FIGS. 1 to 5 in order to assist with initial venting during opening. According to this design, the skirt 202 is generally outwardly convex, is formed with an inwardly directed curl 203 at the bottom of the skirt and has a generally smooth outwardly facing surface. In other words, the inwardly directed curl 203 is configured such that no discontinuities interrupt the gripping surface of the closure, and the gripping surface is rimless. Furthermore, a small number of ribs 204 are defined in the sealing compound 205 provided on the inside of the closure. This process involves compound moulding, prior to curling the end of the closure sidewall. Whilst the ribs are substantially vertical, they may have a small angle of approximately five degrees to allow demoulding from the moulding punch and to aid closure alignment during capping. NB It may also be possible to use insert moulded TPE materials. In this case the ribs may be much thinner as the filling is done as part of the injection moulding operation.

The ribs do not impinge on that part of the sealing compound that provides the seal to the upper rim of the container, but rather extend only down the sidewall part of the closure. In FIG. 7B, only six of the (ten) ribs are visible. In this design, the curl 203 around the bottom of the skirt does not contact the container rim, i.e. the inner diameter of the curl is greater that the outer diameter of any part of the container neck. However, as the ribs are radially or diametrically smaller than the curl, the ribs 204 are in contact with the container. The spaces provided between the ribs allow for venting upon twisting of the cap.

By way of example only, two possible closure configurations are:

- External diameter of around 52.3 mm, thickness 0.15, temper TH580
- External diameter of around 56.7 mm, thickness 0.15, temper TH580.

For both configurations, the following dimensions apply prior to capping:

- Height of closure is 6.0 mm
- Inward curl diameter is around 1.2 mm
- Ribs are around 3 mm wide as moulded before capping
- Radial depth of ribs is around 1.7 mm as moulded before capping
- Radial depth of compound between ribs is around 0.2 mm.

NB. Following capping and curing of the compound, the radial depth of the ribs is reduced to around 1.3 mm. In FIG. 8B the dark line shows the profile of the sealing compound prior to pressing the closure onto the container.

The application force required to initially apply the closure onto the glass container is relatively high. However, the compound subsequently "creeps" to accommodate the tolerance in the glass finish giving a uniform retention force which is substantially independent of the glass diameter. Creep occurs on application of the closure and during processing when the container is heated.

Referring again to the detail of FIG. 8B, it is noted that the neck of the glass container is formed with a tapered clip feature. More specifically, the transfer bead on the jar has a re-entrant taper on the lower portion so that, after capping, the compound ribs wrap around the transfer bead. During processing of the food, the compound ribs have been found to creep, further enhancing the positive clip feature. The radial extent of the re-entrant taper is typically around 0.2 mm+−0.1 mm for a 51 mm diameter closure. It has been found that these dimensions facilitate a positive reclose whilst still providing for easy removal of the closure by the consumer (after initial opening and reclosing), by lifting the closure gently on one side using the fingertips.

The design of FIGS. 7 and 8 presents a relatively small total contact area between the ribs and the container wall. This is sufficient to retain the closure on the container body, providing a degree of tactile feedback to the consumer when the closure is pressed onto the container body, whilst not giving rise to an excessive frictional force that must be overcome to remove the closure on first opening. Of course, the number and dimensions of the ribs may be varied to achieve the desired opening and closing properties. It will also be appreciated that this design avoids the need to fill the gap between the container neck and the closure with sealing compound around the entire circumference, this gap being relatively large due to the inward curl. Sealing compound is relatively expensive and any reduction represents a valuable saving. The reduction in the total volume of sealing compound also reduces the possibility for migration of chemicals from the compound to the food product, and reduces the moulding time.

Figure 9:
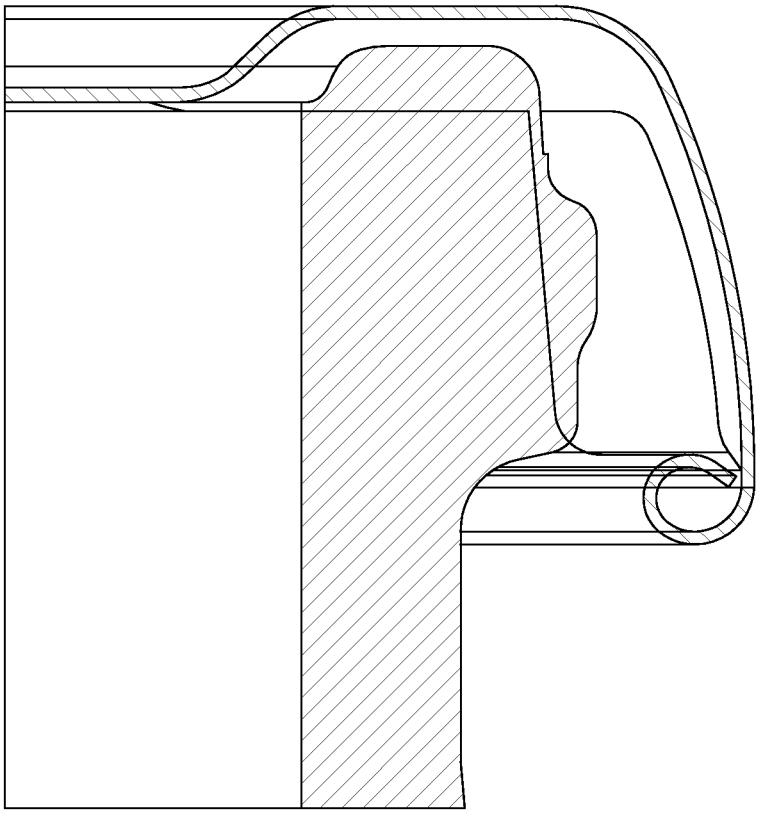
FIG. 9 shows in cross-section the closure of FIG. 7 fitted over an alternative container, the container having a stepped profile around its neck.

FIG. 9 shows a detail of an alternative embodiment in which the tapering profile of the transfer bead is replaced with a stepped clip feature. This has a similar function to the tapering profile but has the benefit that the stepped-in diameter can be measured more easily which is useful for quality control on the production line. The stepped clip may also offers improved positive closure feedback (tactile and audible) during re-closure.

Figure 10:
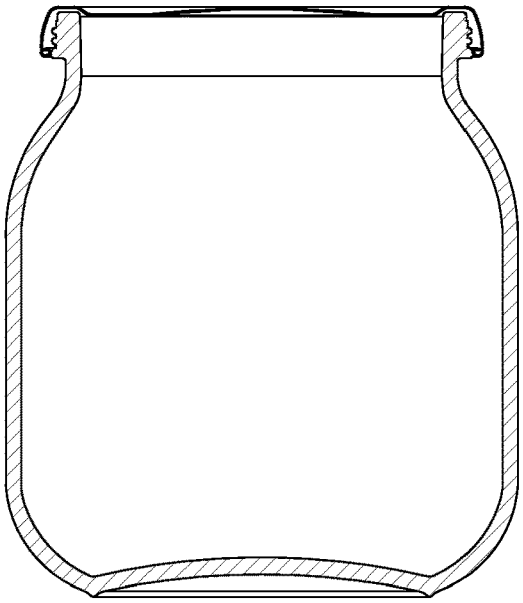
FIG. 10 shows in cross-section the closure of FIG. 7 fitted over an alternative container, the container having a thread formed around its neck.
Figure 10A:
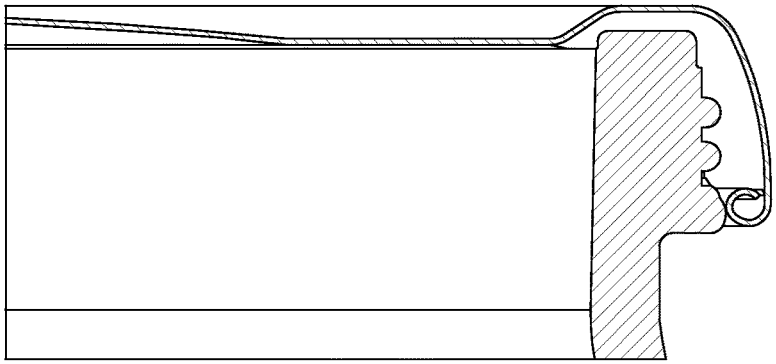
Figure 10B:
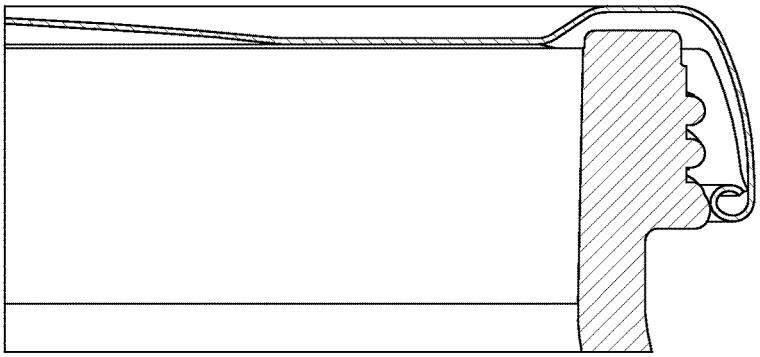

According to the embodiments described above, raising and therefore venting of the container arises as a result of the protrusion/radial rib etc or indent provided in the rim of the container body. As an alternative, or in addition, venting may be achieved by provided threads (full or partial) around the outer neck of the container body. This is illustrated in FIG. 10. The closure is identical or similar to that described above with reference to for example FIG. 7. In the embodiment of FIG. 10, during capping the vertical ribs slide over the fine threads on the glass finish. Then during thermal processing (pasteurising or sterilising) the compound further creeps around the threads to form a female thread impression within the vertical compound ribs. When the closure is twisted, the thread impression in the ribs act as discontinuous threads and push the closure upwards, breaking the vacuum in the jar. The threads and thread impression in the ribs nonetheless allow re-closure, i.e. to act as a dust cover.

Figure 11A:
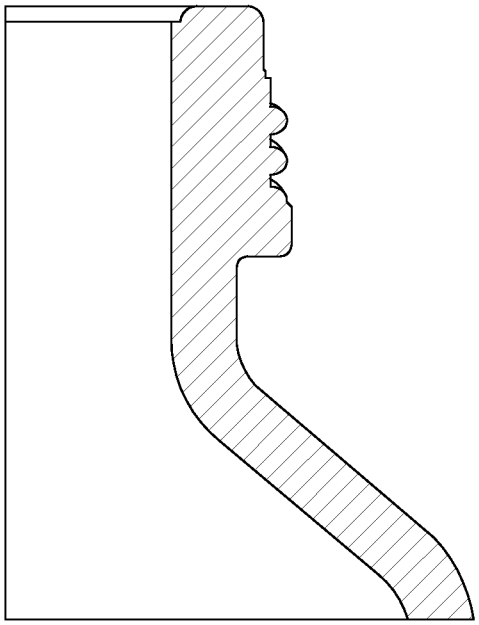
FIG. 11 illustrates, in cross-section, two alternative closure neck profiles.
Figure 11B:
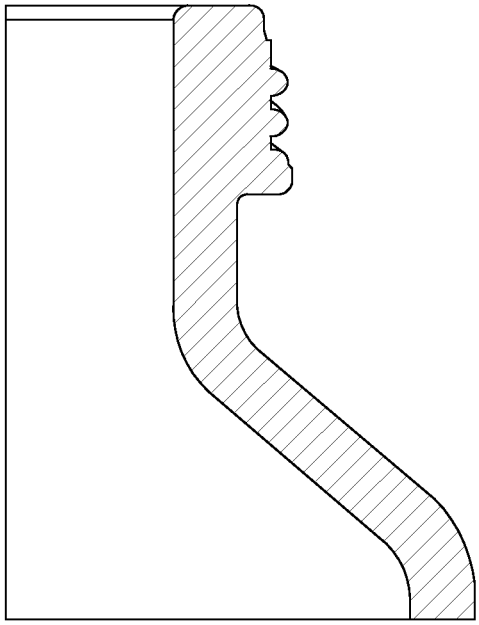

In order to achieve optimum performance in the case of a closure having a depth of 6 mm, certain dimensional charges are made to the neck profile of the conventional threaded container body. In particular, the top seal wall is reduced in height by around 1 mm. This is to provide optimum glass thread and vertical rib engagement to provide sufficient purchase for opening and reclose. Additionally, the transfer bead height under the thread is reduced in order to prevent the glass finish from extending below the closure rim. This makes the rimless closure easy to grip for removal and improves pack appearance. FIGS. 11A and 11B illustrate respectively the conventional and modified neck profiles, with respective dimensions shown beneath the Figures.

In designing improved closures, the following factors have been found to be of importance:

- Height of the closure is less than 10 mm
- Radial thickness of compound ribs prior to capping is greater than 1.5 mm
- Radial thickness of compound between ribs prior to capping is less than 0.5 mm
- Radial thickness of compound ribs after capping is greater than 1.0 mm
- Ratio of compound thickness in ribs to that between ribs is greater than 2:1
- Number of compound ribs is less than 16
- Width of the ribs (circumferential) is around between 2 and 3 mm, preferably 2.5 mm.

It will be appreciated by the skilled person that various modifications may be made to the above described embodiments without departing from the scope of the present invention.

The invention claimed is:

1. A closure for a container and comprising:

an end panel;

a generally curved outwardly convex sidewall depending from the end panel and terminating in an inwardly directed curl;

wherein the curl lies radially inside of the sidewall such that the sidewall and the curl form an outwardly facing convex surface; and a sealing compound extending down an inner surface of the sidewall, wherein a plurality of ribs are formed in the sealing compound, spaced apart around the circumference of the sidewall, each rib extending down the sidewall and projecting radially inwardly.

2. The closure according to claim 1, wherein each rib extends down the sidewall substantially from the junction with the end panel to the curl.

3. The closure according to claim 1, wherein the ratio of the radial thickness of the layer of sealing compound in each rib to the radial thickness of the layer of sealing compound between the ribs is at least 2:1.

4. The closure according to claim 1, wherein the ratio of the radial thickness of the layer of sealing compound in each rib to the radial thickness of the layer of sealing compound between the ribs is at least 4:1.

5. The closure according to claim 1, wherein the ratio of the radial thickness of the layer of sealing compound in each rib to the radial thickness of the layer of sealing compound between the ribs is at least 8:1.

6. The closure according to claim 3, wherein the layers of sealing compound in the ribs have a radial thickness of at least 1.5 mm and the layer of sealing compound between the ribs has a radial thickness of less than 0.4 mm.

7. The closure according to claim 1, the end panel and the depending sidewall being of metal.

8. The closure according to claim 7, the end panel and the depending sidewall being of steel.

9. The closure according to claim 1, wherein the total number of ribs is between three and thirty six.

10. The closure according to claim 1, wherein the total number of ribs is between four and sixteen.

11. The closure according to claim 1, the maximum external diameter of the closure being in the range 52 to 57 mm, and the closure having a depth of less than 10 mm.

12. The closure according to claim 1, the maximum external diameter of the closure being in the range 52 to 57 mm, and the closure having a depth of less than approximately 6 mm.

13. The closure according to claim 1, said sealing compound being PVC plastisol or moulded TPE.

14. The closure according to claim 1, wherein an innermost surface of each rib is angled relative to the axis of the container, along the length of the rib, by approximately 5 degrees.

15. The closure according to claim 1, wherein said sealing compound extends around an inner periphery of the end panel.

16. The closure according to claim 1, wherein the inner surface of the sidewall defines a cavity that extends circumferentially about the end panel, the sealing compound being positioned within the cavity.

* * * * *